United States Patent [19]

Chang

[11] 4,300,700

[45] Nov. 17, 1981

[54] CLOSABLE FOOD CONTAINER BODY AND UTENSIL ENCLOSING COVER ASSEMBLY

[75] Inventor: Henry M. Chang, Bronx, N.Y.

[73] Assignee: Container Dynamics, Inc., Miami Beach, Fla.

[21] Appl. No.: 163,279

[22] Filed: Jun. 26, 1980

[51] Int. Cl.[3] ..... B65D 51/20; B65D 39/00

[52] U.S. Cl. ..... 220/257; 220/85 D; 220/307; 220/23; 150/0.5; 229/43; 229/75

[58] Field of Search ..... 220/23, 257, 306, 307, 220/85 D; 150/0.5; 215/1 A; 229/75, 43; 206/217

[56] References Cited

U.S. PATENT DOCUMENTS

| | | | |
|---|---|---|---|
| 2,901,098 | 8/1959 | Tupper | 220/270 |
| 3,401,825 | 9/1968 | Weiss | 220/307 |
| 3,448,888 | 6/1969 | Smith et al. | 220/306 |
| 3,817,420 | 6/1974 | Heisher | 220/307 |
| 3,874,554 | 4/1975 | Chang | 220/85 D X |
| 4,006,839 | 2/1977 | Thiel et al. | 220/266 |
| 4,124,141 | 11/1978 | Armentrout et al. | 220/306 |

*Primary Examiner*—George T. Hall
*Attorney, Agent, or Firm*—Lane, Aitken, Kice & Kananen

[57] ABSTRACT

A closable food container body and utensil enclosing cover assembly of generally rectangular outline and in which the cover assembly is received by snap fit in the opening of the container body to seal the contents thereof. Both the cover assembly and the container body are formed with overlying coextensive peripheral flanges which may be planar to inhibit opening of the container once closed, deformed to facilitate opening of the container, formed to augment removable retention of the cover and the container body, or formed to provide a tamper proof closure. The cover assembly includes a utensil recess for receiving a spoon, a fork, or a drinking straw and is closed by a removable cover sheet secured to a central cover member panel about the periphery of the utensil recess but having a loose, unattached peripheral portion to facilitate grasping for manual removal to gain access to the utensil.

20 Claims, 15 Drawing Figures

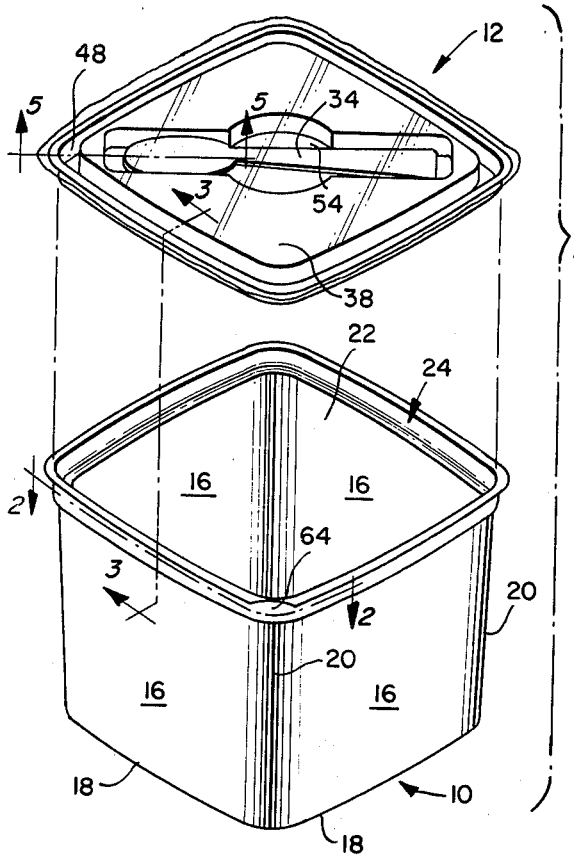
FIG. 1.
FIG. 2.
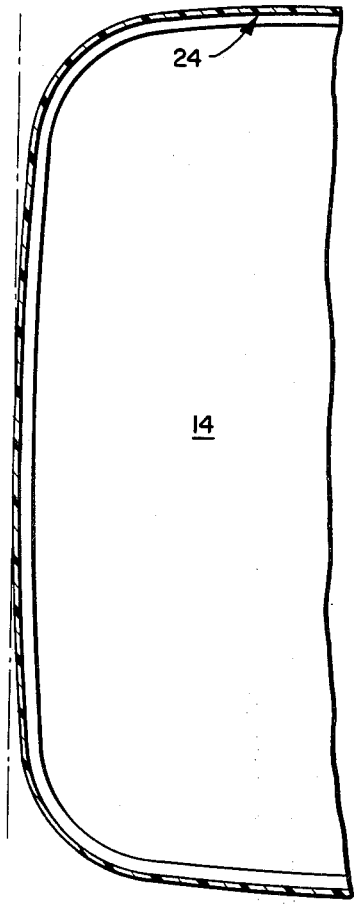
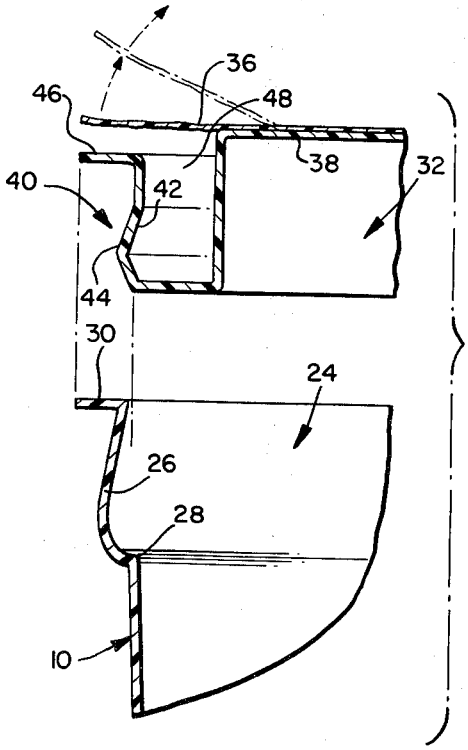
FIG. 3.
FIG. 4.
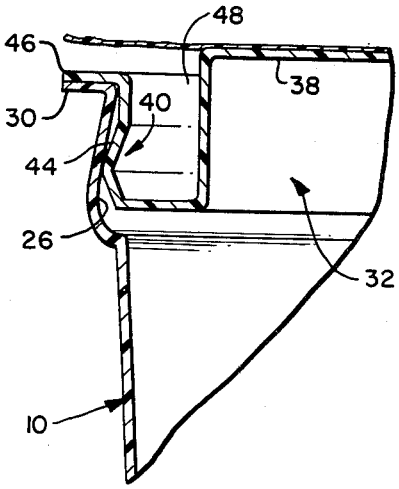

FIG. 11.
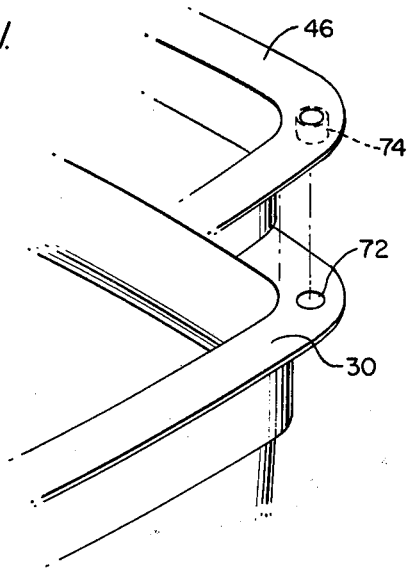
FIG. 12.
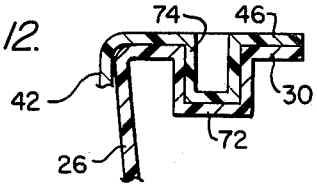
FIG. 13.
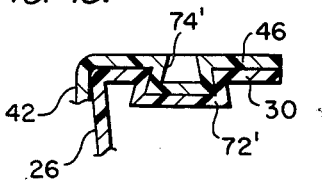
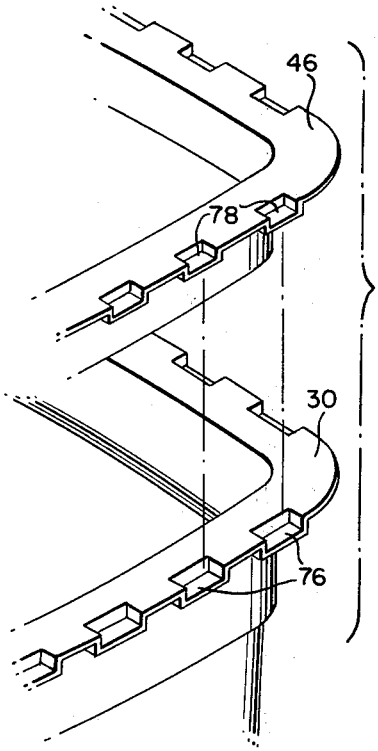
FIG. 14.
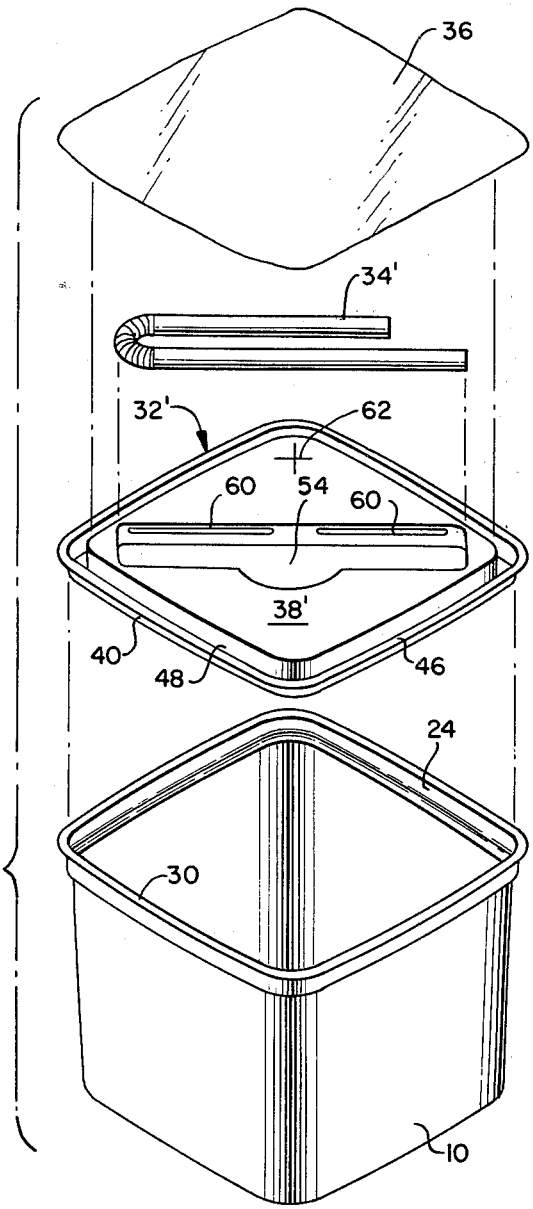
FIG. 15.

CLOSABLE FOOD CONTAINER BODY AND UTENSIL ENCLOSING COVER ASSEMBLY

BACKGROUND OF THE INVENTION

This invention relates to closable food containers and more particularly, it concerns food containers in which a container body of substantially rectangular outline and having a generally square opening is adapted to receive by snap fit a cover carrying an initially sealed eating or drinking utensil for consumption of food contained in the receptacle either by penetration or removal of the cover.

U.S. Pat. No. 3,851,411 exemplifies a machine for producing and filling containers in which a drinking straw is packaged with the filled container. In general, the disclosed machine operates to convert three sheets of relatively thin thermoplastic synthethic resinous material into a cube-like receptacle, a cover formed to provide a straw recess, and a removable cover sheet to overlie and at least partially retain a straw until removed and used to consume the liquid drink in the container. The cover and container are permanently sealed to each other and access to the container contents is possible by manually thrusting the straw through a puncturable depression formed in the cover. An example of a container so formed and filled by this type of machine is shown in U.S. Pat. No. 3,874,554.

The packaging system represented by the disclosure of these prior patents is used commercially and has demonstrated substantial promise from the standpoint of providing a low cost, completely sealed and inherently sanitary assembly of a drink container and a straw. The rectangular outline or generally cubic shape of the container is uniquely attractive as well as functional both for conservation of shipping and storage space and for accommodating the packaged straw. In this latter respect, the square configuration of the container top allows a straw of adequate length to be folded in a recess extending diagonally across the cover.

While the existing commercial packaging system is, therefore, highly effective for prepackaged drinks or liquids which may be consumed using a straw, there is need for adaptability of the desirable attributes of the system to a wider range of food products and food or drink marketing procedures. While it is possible, for example, to fill the container with solid or semi-solid food products and substitute a spoon or fork for the straw of the existing container, the permanent seal of the cover to the container prevents or severely impedes the attainment of an opening necessary for the use of a spoon or fork. Also, the present heat sealing or fusion of the cover to the container prevents or at least restricts use of preformed containers and cover/utensil assemblies after manufacture at concession stands or other such food retail outlets where filling is effected at the time of sale.

Although the state-of-the-art relating to closable containers is highly developed and replete with plastic container/cover constructions capable of satisfying the aforementioned needs, several problems are presented in the attainment of a low cost, thermoformed or draw molded rectangular receptacle and an initially sealed but removable cover capable of carrying an enclosed eating or drinking utensil. It is virtually impossible, for example, to attain a good cover-to-container seal along the linear edge of a square opening, given the materials of the existing system, unless one of either the cover edge or the receptacle opening edge envelopes or wraps about the other of such edges. The provision of such a removable edge enveloping sealing closure, however, adds costs particularly to the machinery needed to produce the container and cover.

It is also important that the basic container/cover structure lend itself to production on a given machine and yet be capable of variation to accommodate different marketing requirements. An ideal container for drinks sold at a concession stand, for example, would be one which is easily closed by a cover and straw assembly after filling, easily punctured by the straw and yet difficult or impossible to open in the interest of preventing accidental spillage. The same container used for ice cream or yogurt, on the other hand, whether prefilled by machine or filled after manufacture, and closed by a cover and spoon assembly, must of necessity be easy to open by removing the cover. In addition, the same container used in some marketing circumstances might require a tamper proof adjunct such as a provision for preventing closure of the cover once it is opened. Other marketing circumstances may require emphasis on the space available for advertisement or "billboard space" as it is known in the art. Here again, the basic container structure should be retained in the interest of manufacturing economics.

SUMMARY OF THE INVENTION

In accordance with the present invention, an improved closable food container is provided by which the desirable characteristics of a rectangular container outline and utensil carrying cover are retained in a container/cover structure which provides for sealing the container contents and for removal of the cover as well as easy access to an eating or drinking utensil initially enclosed in the cover. The container includes an opening of generally square outline circumscribed by a continuous upright or generally vertical seating formation terminating at its top edge in an outwardly projecting flange. The cover has a peripheral edge formation to complement the seating formation and also includes an outwardly projecting flange to overlie the flange of the container seating formation in coextensive relationship. The square outline of the container opening, and correspondingly of the cover periphery, is rounded at the corners and cambered outwardly along the sides to provide for the development of opposing tensile and compressive hoop stresses in the respective seating formation and peripheral edge of the cover when the latter is snap fit into the opening. The central area of the cover is formed with a utensil recess which, when loaded, is covered by a removable tear sheet releasably bonded to the central cover area and preferably extending loosely around the periphery of the cover to facilitate removal. The overlying flanges on the cover periphery and at the top of the container seating formation may be left planar to impede removal of the cover once it is closed; one or the other of the flanges may be deformed to provide a region or regions of flange separation to facilitate removal of the cover; or the flanges may be provided with non-reclosable interlocking formations which prevent reclosure of the cover once opened in a tamper proofing context.

A primary object of the present invention is to provide a closable food container of generally rectangular or square outline, which is easily and economically manufactured using existing machinery and materials and which is applicable to a wide range of food products and food merchandising criteria. Other objects and further scope of applicability of the present invention will be apparent from the detailed description to follow taken in conjunction with the accompanying drawings in which like parts are designated by like reference numerals.

BRIEF DESCRIPTION OF THE DRAWINGS

FIG. 1 is an exploded perspective view illustrating one embodiment of the invention;

FIG. 2 is an enlarged fragmentary cross-section on line 2—2 of FIG. 1;

FIG. 3 is an enlarged fragmentary cross-section on line 3—3 of FIG. 1;

FIG. 4 is a cross-section similar to FIG. 3 but showing the cover and container in a closed condition;

FIG. 11 is an exploded fragmentary perspective view illustrating a further embodiment of the invention;

FIG. 12 is a fragmentary cross-section through the flange deformation illustrated in the embodiment of FIG. 11;

FIG. 13 is a fragmentary cross-section similar to FIG. 12 but showing an alternative form of the structure illustrated in FIG. 12;

FIG. 14 is an exploded fragmentary perspective view illustrating an alternative form of the embodiment illustrated in FIGS. 11–13; and FIG. 15 is an exploded perspective view illustrating an alternative form of the container of this invention and which is adapted for liquid or other food products adapted to be consumed using a straw.

DETAILED DESCRIPTION OF THE PREFERRED EMBODIMENTS

Figure 5:
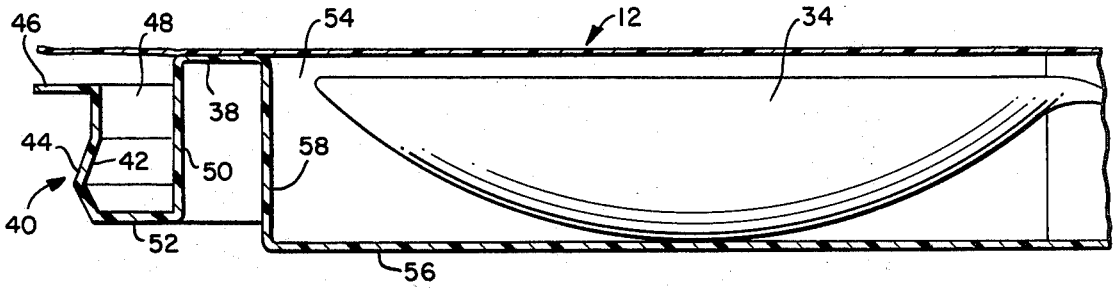
FIG. 5 is an enlarged fragmentary cross-section similar to FIG. 3 but showing only the container cover assembly.

In FIGS. 1–5 of the drawings, an embodiment of the invention is shown to include a container body and a cover assembly generally designated by the reference numerals 10 and 12, respectively. The container body 10 is substantially rectangular or square in outline and includes a bottom wall 14 to which four upstanding sidewalls 16 are joined by relatively angular bottom corners 18. The upstanding sidewalls 16 are joined to each other at rounded, specifically arcuate, upstanding corners 20. The upper edges of the upstanding sidewalls 16 and corners 20 circumscribe a generally square container opening 22 at a continuous seating formation generally designated by the reference numeral 24.

As best shown most clearly in FIGS. 3 and 4 of the drawings, the seating formation 24 is in the nature of an undercut lip to define in vertical section, an interior concave surface 26 extending upwardly from a ledge 28 spaced below the upper extremity or top edge of the upstanding sidewalls and corners 16 and 20. The surface 26 extends to and joins with an outwardly projecting or horizontal body flange 30 of substantially uniform width throughout the periphery of the container opening 22 and of the seating formation 24.

The cover assembly 12 in the embodiment of FIGS. 1–5 includes an integral cover member 32, a utensil 34, in this instance a spoon, and a removable cover sheet 36. While the arrangement of the utensil 34 as well as the removable cover sheet 36 may vary from that illustrated in FIGS. 1–5 as will be appreciated from the description of alternative embodiment to follow below, the cover member 32 is germane to all embodiments of the invention to the extent that it includes a central panel 38 and a peripheral edge formation 40 adapted to be removably snap fit within the seating formation 24 of the container body 10.

The edge formation 40 on the cover member 32 is shown most clearly in FIGS. 3–5 of the drawings to include a generally vertical edge wall portion 42 which defines an exterior convex surface 44 adapted to nest within and seal against the convex surface 26 of the seating formation 24 in the receptacle body 10. The edge wall portion 42 depends from an outwardly projecting or horizontal cover flange 46 having a peripheral edge outline identical with that of the flange 30 on the container body 10. Also it will be noted that the convex surface 44 projects beyond the inner edge of the container body flange 30 so that insertion of the cover member 32 into the receptacle opening 22 will effect a snap fit retention of the cover in the seating formation 24.

As mentioned above with reference to FIG. 1 of the drawings, the container opening 22 is generally square in outline and in which the sides of the square outline are joined at rounded corners which are essentially extensions of the rounded upstanding corners 20 in the illustrated embodiment. In addition, and as shown in FIG. 2 of the drawings, the sides of the outline, at least in the region of the seating formation 24, are cambered outwardly in the nature of a long radius curve merging tangentially with the relatively small radius curve at the corners. The peripheral edge formation 40 of the cover member 32 complements the configuration of the opening 22 and of the seating formation 24 so that the sides of the generally square outline of the cover member are also outwardly cambered. As a result of this configuration of the cover member and of the seating formation 24 on the receptacle body 10, when the cover member 32 is snap fit into the seating formation 24, a continuous seal will be established between the convex surface 44 and the concave surface 26 as a result of tensile and compressive hoop stresses in the seating formation 24 and the peripheral edge formation 40, respectively. Yet the basic, generally rectangular container outline is essentially retained.

In the embodiment of FIGS. 1–5, the central panel 38 of the cover member 32 is peripherally spaced from the cover flange 46 of the edge formation 40 by a continuous reentrant groove formation 48 defined on one side by the edge wall portion 42, on the other side by a sidewall portion 50 and at its base by a groove floor 52. Preferably, but not necessarily, the height of the sidewall portion 50 is at least equal to or slightly greater than the height of the edge wall portion 42 so that the plane of the central panel 38 will lie above the plane of the cover flange 46 as shown most clearly in FIGS. 3–5.

Also, the central panel 38 is formed with a utensil recess 54, re-entrant in form, and having a floor 56 joined to and circumscribed by marginal sidewalls 58 extending between the central panel 38 and the floor 56. The recess 54 extends diagonally of the cover assembly and in the embodiment of FIGS. 1–5 is shaped to receive a spoon as the utensil 34 but may be shaped to receive other eating or drinking utensils such as a fork, a pick or a straw as will be appreciated from the description to follow below.

As may be seen in FIG. 1, the area occupied by the recess 54 fits within the area of the central panel 38 as defined by the groove sidewall 50 so that the marginal sidewalls 58 are spaced at all places from the groove 48 by some portion of the area of the central panel 38. As a result, the cover sheet 36, which is relatively thin and flexible by comparison to the cover member 32, may be releasably secured by an appropriate adhesive directly to the area of the central panel 38 and thus completely enclose or seal the utensil 34 within the recess 54. The removable sheet 36 is preferably of the same peripheral configuration as the cover flange 46. Partly because the plane of the central panel 38 is spaced slightly from the plane of the cover flange 46 and partly because of the re-entrant groove 48, the edge portions of the removable sheet are easily delineated from the adhered central area thereof and project across the re-entrant groove 48 in a manner to be easily grasped anywhere about the periphery of the cover assembly for removal to gain access to the utensil 34.

In FIG. 15 of the drawings, an alternative embodiment of the invention is shown in which components identical to those described with reference to FIGS. 1–5 are identified by the same reference numerals and in which components which are the functional equivalent of previously identified components are identified by the same reference numerals but primed. Thus, in FIG. 15 the principal departure from the previously described embodiment resides in the arrangement of the cover assembly, specifically the cover member 32' and the utensil 34'. In this instance, the utensil is a folded straw adapted to fit within the recess 54' in essentially the same manner as that described in the aforementioned U.S. Pat. No. 3,874,554. As such, the marginal sidewalls of the recess 54' are provided with projecting rib-like formations 60 so that the straw 34' will be retained mechanically within the recess 54'. Also the recess 54' as well as the recess 54 described above with respect to FIG. 1 may be undercut or otherwise formed so that primary mechanical retention in the recess is afforded by the shape of the recess. While additional retention is provided by the cover sheet 36, the primary function of the cover sheet with this type of recess is to enclose the utensil 34 or 34' and protect it against contamination.

The central panel 38' of the cover member 32' in the embodiment of FIG. 15 is provided with a straw penetrable scored or cross-cut opening 62 through which the straw may be inserted after the cover sheet 36 has been removed. The cover sheet 36 is attached to the cover member 32' in the same manner as the previously described embodiment and so that the marginal edges project loosely over the re-entrant groove 48 and the flange 46. By securing the cover sheet 36 to the entire flat area of the central panel 38' the crosscut straw opening 62 will be both sealed and protected from contamination.

The embodiment of FIG. 15 is particularly well suited for use in concession stands or other similar retail establishments which may be supplied with quantities of container bodies and separate cover assemblies. In such usage, the container may be filled and the cover assembly applied manually to effectively seal the contents in the container. In this application, it is preferred that the flanges 30 and 40 on the container body and cover member 32', respectively, overlie each other in continuous uniform coextensive relationship. As may be appreciated from FIG. 4, the flanges 30 and 46, being drawn against one another, will be difficult to separate, thus impeding removal of the cover member 32' from the receptacle body 10. Yet a drink or liquid supplied in the container is easily accessible by removing the cover sheet 36, removing the straw 34' from the recess 54' and inserting the straw through the now accessible scored opening 62. Accidental spillage of the liquid or drink is prevented because of the impediment to removing the cover member 32' from the container 10.

In other marketing circumstances, such as where the container body is filled with a solid food requiring the use of a spoon or fork for its consumption, the embodiment of FIG. 1 is preferred. Not only is the cover assembly provided with a spoon utensil 34 but also it will be noted that one corner of the container body flange 30 is provided with a notch or cut-out 64. As a result of the cut-out 64, a portion of the cover flange 46 is easily accessible to be grasped manually, lifted and the cover assembly 12 removed either before or after removing the cover sheet 36 for access to the spoon utensil 34.

Figure 9:
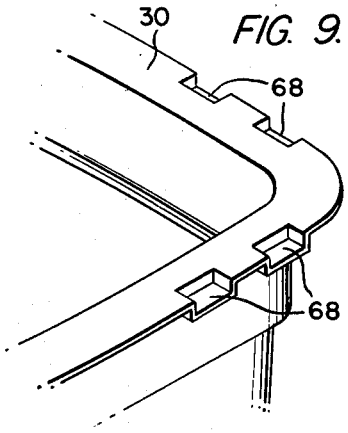
FIG. 9 is a fragmentary perspective view similar to FIG. 7 and showing another alternative embodiment of the invention.
Figure 10:
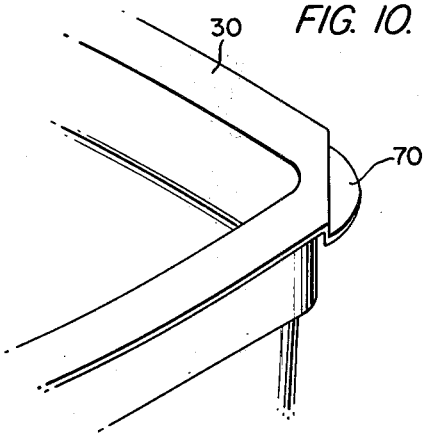
FIG. 10 is a fragmentary perspective view similar to FIGS. 7 and 9 but showing still another alternative embodiment of the invention.

Alternative forms of flange deformations by which removal of the cover assembly is facilitated are shown in FIGS. 7–10 of the drawings. Thus in FIGS. 7 and 8, one or more dimple-like embossments 66 may be provided in the container body flange 30 to provide a region or regions where the cover flange 46 will be spaced from the body flange for initial grasping and removal of the cover assembly. In FIG. 9, waffle-like depressions 68 or ruffles are formed in the container body flange 30 to the same end. In FIG. 10, one or more corners of the container body flange 30 is provided with a depressed stepped portion 70 for access to the cover flange 46. It is contemplated that the flange deformation shown in FIGS. 7–10 may be applied equally to the cover flange 46 as to the container body flange 30.

In FIGS. 11–14, further variations of flange formations are shown. In these instances, both the cover flange 46 and the container body flange 30 are provided with complementing formations which will augment the retention of the cover assembly to the container body after the latter is filled. Thus, in FIGS. 11 and 12, the container body flange 30 is provided at its corners with a depression 72 to receive a complementing and depending projection 74 on the cover flange 46. As may be seen in FIG. 12, the formations 72 and 74 may be designed to mate by press fit to facilitate reclosure. On the other hand, the receptacle portion 72 of the fastener assembly may be undercut in the nature of a conventional snap fastener to provide a more positive retention of the cover flange 46 and the container body flange 30 such an arrangement is illustrated in FIG. 13 in which the formations 72' and 74' correspond to the cylindrical formations of FIGS. 11 and 12. In addition, it is contemplated that the flanges 30 and 46 might be spot welded or fused to assure retention of the cover assembly and body but yet enable removal of the cover.

In FIG. 14 the flanges 30 and 46 are provided with a series of step-like depressions 76 and 78 to present a waffle-like or corrugated conformation in the respective edges of the flanges. As in the embodiment of FIGS. 11 and 12, the formations 76 and 78 may be undercut either to augment the retention of the cover assembly to the container body or to provide a tamper proof connection of the cover assembly to the container body. In this latter respect, by increasing the severity of the undercut in the complementing flange formations, the cover may be removed from the container body but not replaced to provide visible evidence that it was once opened.

Figure 6:
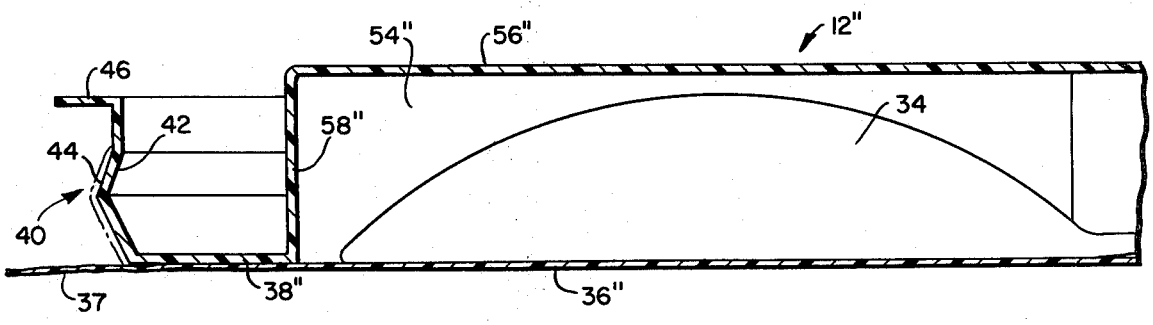
FIG. 6 is a cross-section similar to FIG. 5 but showing an alternative embodiment.
Figure 7:
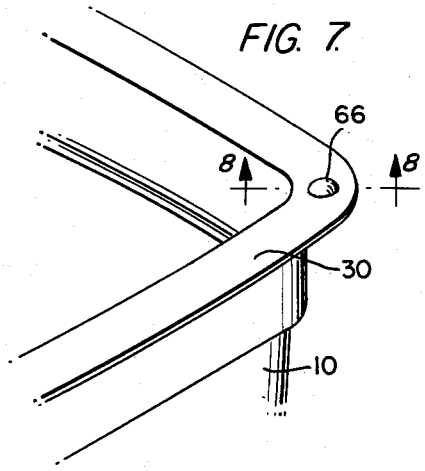
FIG. 7 is a fragmentary perspective view illustrating one form of an alternative embodiment of the container of the invention.
Figure 8:
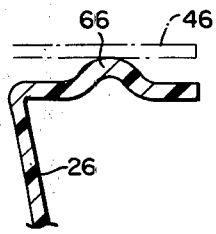
FIG. 8 is an enlarged fragmentary cross-section on line 8—8 of FIG. 7.

In FIG. 6 of the drawings, a further alternative embodiment of the cover assembly is shown and designated generally by the reference numeral 12″. This embodiment is similar to the embodiment described above with reference to FIG. 1 of the drawings and includes the identical peripheral edge formation 40 to be received in the seating formation 24 of the container body 10. In this embodiment however, the central panel 38″ is in a plane at or spaced slightly below the bottom of the peripheral edge formation 40 and the utensil recess 54″ is struck upwardly from the panel 38″ so as to open through the bottom of the cover assembly 12″. The removable cover sheet 36″ is again attached to the central panel 38″ so that a utensil such as a spoon 34″ may be contained under the cover member 32″. In addition, at least the corners of the cover sheet 36″ may extend as tabs 37 which, when the cover assembly 12″ is applied to a container body 10, will be tucked between the edge formation 40 on the cover member and the seating formation 24 on the body to isolate it from the contents in the container. The primary advantage of the embodiment in FIG. 6 is that the complete upper surface of the cover member 32″ is available as printing space for advertisements and the like. In addition, the utensil may be concealed from direct view and the size of the cover sheet 36″ may be reduced to a size adequate only to cover the utensil recess 54″. In the packaging of certain types of food it also may be possible to eliminate the cover sheet 36″ in the embodiment of FIG. 6 by providing the recess 54″ with a significant undercut to retain the spoon 34″ or other utensil exclusively by mechanical means. From the standpoint of retaining the utensil in a sanitary condition as well as to prevent contamination of the spoon with the contents of the container, the removable cover sheet 36″ is preferred.

In light of the several embodiments and variations of the embodiments illustrated and described herein, the adaptability of the basic container of this invention to a wide range of food and drink packaging needs will be appreciated. Yet, all forms of the cover assembly, the container body or combinations of these two parts enable manufacture of the cover member and container body using low cost thermoforming of relatively thin gauge, sheet plastics including, for example, polyvinylchloride, ABS, styrene, polypropylene, cellulose acetate and the like. Sheet stock of such materials ranging in thickness from 6 to 30 mils may be used through a preferred range, from the standpoint of optimizing a combination of material cost, thermoforming procedures and container strength is a thickness range of between 12 and 15 mils.

Also it is to be noted that a significant measure of versatility in retaining the cover assembly and the container body is provided by modification only to the respective peripheral flanges in these parts. Because both flanges are of an identical peripheral shape, they may be cut using the same die. The various flange formations also may be accommodated very easily during manufacture as a result of relatively minor modifications in the respective container and cover member forming dies.

It is contemplated and believed apparent to those skilled in the art from the preceding description that modifications and/or changes may be made in the illustrated embodiments without departure from the present invention. It is expressly intended, therefore, that the foregoing description and accompanying drawings are illustrative of preferred embodiments only, not limiting, and that the true spirit and scope of the present invention be determined by reference to the appended claims.

I claim:

1. A closable container comprising:

a container body, substantialy rectangular in outline, including a bottom wall and four upstanding sidewalls joined by bottom corners to said bottom wall and by upstanding corners to each other, each of said upstanding corners being rounded, the upper edges of said upstanding sidewalls and corners circumscribing a container opening and having a continuous seating formation to define, in vertical section, an interior concave surface extending upwardly from a plane spaced below the top edge of said upstanding sidewalls and corners to an outwardly projecting peripheral body flange at the top edge of said upstanding walls and corners;

a cover having a central panel and a peripheral edge formation to seal within said seating formation, said edge formation having an edge wall portion depending from an outwardly projecting cover flange, said edge wall portion having, in vertical section, an exterior convex surface;

said seating formation and said edge formation being generally square in outline in which the sides of said outline are cambered outwardly and joined at rounded corners, thereby to provide for development of opposing tensile and compressive hoop stresses in said seating formation and said peripheral edge formation, respectively upon insertion of said cover into said seating formation so that said exterior convex surface nests within and seals against said interior concave surface continuously about said container opening;

means defining a utensil recess in said central panel and extending diagonally of said cover, said recess having a floor joined to and circumscribed by marginal sidewalls spaced from said peripheral edge formation; and means for releasably retaining a utensil in said recess.

2. The apparatus recited in claim 1, wherein said means for releasably retaining a utensil in said recess comprises a removable cover sheet releasably attached to said central panel in an area extending about said marginal sidewalls and within said peripheral edge formation.

3. The apparatus recited in claim 2, wherein said central panel is peripherally spaced from said cover flange by a continuous re-entrant groove formation defined on one side by said edge wall portion, said marginal sidewalls of said recess depending from said central panel in the same direction as said edge walls depend from said cover flange.

4. The apparatus recited in claim 3, wherein said removable cover sheet is coextensive with the area circumscribed by and overlies said cover flange, the area to which said removable cover sheet is releasably attached being restricted to the area of said central panel, thereby providing a loose peripheral portion of said cover sheet to be grasped for removal thereof from said cover and said recess.

5. The apparatus recited in either of claims 2 or 3, wherein said central panel includes a straw penetrable opening spaced from said recess, said cover sheet being releasably secured initially over said penetrable opening.

6. The apparatus recited in claim 5, wherein said cover flange and said body flange are continuously coextensive and flat to overlie each other in a manner impeding removal of said cover from said body.

7. The apparatus recited in claim 1, wherein said central panel lies in a plane spaced below the bottom of said edge wall portion, said recess opening through the bottom of said cover so that the floor of said recess lies near the plane of said cover flange.

8. The apparatus recited in claim 5, wherein said means for retaining a utensil in said recess comprises a removable cover sheet releasably attached to the underside of said central panel about the marginal sidewalls of said recess.

9. The apparatus recited in either of claims 1, 2, or 7, wherein one of said cover and body flanges includes a deformation to separate at least a portion of said flanges to facilitate removal of said cover.

10. The apparatus recited in claim 9, wherein said deformation comprises a notch in said body flange thereby to present a portion of said cover flange for grasping.

11. The apparatus recited in claim 9, wherein said deformation comprises a dimple-like projection struck from the plane of one of said flanges.

12. The apparatus recited in claim 9, wherein one of said flanges includes a stepped peripheral portion.

13. The apparatus recited in claim 12, including a series of spaced notch-like stepped portions.

14. The apparatus recited in either of claims 1, 2, or 7, including interlocking formations in said cover and body flanges to augment the retention of said cover and said body.

15. The apparatus recited in claim 14, wherein said interlocking formations are undercut to prevent re-closure once said cover is opened.

16. A generally square cover assembly for a container body having a peripheral undercut seating formation, said assembly comprising:

a cover member having a central panel and a peripheral edge formation to seal within the seating formation of a container body, said edge formation having an edge wall portion depending from an outwardly projecting cover flange and having, in vertical section, an exterior convex surface;

a re-entrant utensil recess formed in said central panel and extending diagonally of said cover assembly, said utensil recess having a floor and marginal sidewalls spaced from said edge wall portion thereby to present a portion of said central panel completely about said recess between said marginal sidewalls and said edge wall portion; and a removable cover sheet releasably secured to said central panel and extending loosely beyond the edges of said central panel to provide a marginal grasping edge for removal of said cover sheet.

17. The apparatus recited in claim 16, wherein said utensil recess opens to the top of said cover member.

18. The apparatus recited in claim 17, wherein said removable cover sheet is of the same size and peripheral shape as that of the flange on said cover member.

19. The apparatus recited in claim 16, wherein said utensil recess opens to the bottom of said cover member.

20. The apparatus recited in either of claims 16, 17, or 18, wherein the plane of said central panel is elevated above said cover flange.

* * * * *